US008091634B2

(12) United States Patent
Corre et al.

(10) Patent No.: US 8,091,634 B2
(45) Date of Patent: Jan. 10, 2012

(54) SINGLE PACKER STRUCTURE WITH SENSORS

(75) Inventors: Pierre-Yves Corre, Eu (FR); Stephane Briquet, Houston, TX (US); Stephen Yeldell, Sugar Land, TX (US); Carsten Sonne, Kota Kinabalu (MY); Edward Harrigan, Richmond, TX (US); Alexander F. Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 220 days.

(21) Appl. No.: 12/361,970

(22) Filed: Jan. 29, 2009

(65) Prior Publication Data

US 2010/0122812 A1 May 20, 2010

Related U.S. Application Data

(60) Provisional application No. 61/116,442, filed on Nov. 20, 2008.

(51) Int. Cl.
*E21B 49/10* (2006.01)

(52) U.S. Cl. ..... 166/250.17; 166/100

(58) Field of Classification Search ..... 166/250.01, 166/264, 100, 101

See application file for complete search history.

(56) References Cited

U.S. PATENT DOCUMENTS

| | | | | |
|---|---|---|---|---|
| 2,441,894 | A | | 5/1948 | Mennecier |
| 2,511,759 | A | | 6/1950 | Williams |
| 2,581,070 | A | | 1/1952 | Blood |
| 2,600,173 | A | | 6/1952 | Sewell et al. |
| 2,623,594 | A | | 12/1952 | Sewell |
| 2,675,080 | A | | 4/1954 | Williams |
| 2,742,968 | A | | 4/1956 | Hildebrandt |
| 2,842,210 | A | | 7/1958 | Ramsey |
| 2,843,208 | A | | 7/1958 | Blood |
| 2,905,247 | A | * | 9/1959 | Vestermark ..... 166/100 |
| 3,915,229 | A | | 10/1975 | Nicolas |
| 3,926,254 | A | | 12/1975 | Evam et al. |
| 4,236,113 | A | | 11/1980 | Wiley |
| 4,500,095 | A | | 2/1985 | Schisler et al. |
| 4,635,717 | A | | 1/1987 | Jageler |
| 4,830,105 | A | | 5/1989 | Petermann |
| 4,886,117 | A | | 12/1989 | Patel |
| 4,923,007 | A | | 5/1990 | Sanford et al. |
| 5,335,542 | A | * | 8/1994 | Ramakrishnan et al. .. 73/152.08 |
| 5,358,039 | A | | 10/1994 | Fordham |
| 5,361,836 | A | | 11/1994 | Sorem et al. |
| 5,404,947 | A | | 4/1995 | Sorem et al. |
| 5,439,053 | A | | 8/1995 | Eslinger et al. |
| 5,549,159 | A | * | 8/1996 | Shwe et al. ..... 166/250.02 |
| 5,605,195 | A | | 2/1997 | Eslinger et al. |

(Continued)

FOREIGN PATENT DOCUMENTS

| | | |
|---|---|---|
| EP | 0528327 | 2/1993 |

(Continued)

*Primary Examiner* — Jennifer H Gay
*Assistant Examiner* — Blake Michener
(74) *Attorney, Agent, or Firm* — David J Smith

(57) ABSTRACT

A technique involves collecting formation fluids through a single packer having at least one drain located within the single packer. The single packer is designed with an outer flexible skin and one or more drains coupled to the outer flexible skin. The single packer further comprises one or more sensors positioned to detect one or more specific parameters that may be related to well characteristics and/or single packer characteristics.

17 Claims, 9 Drawing Sheets

U.S. PATENT DOCUMENTS

| | | | | |
|---|---|---|---|---|
| 5,613,555 | A | 3/1997 | Sorem et al. | |
| 5,687,795 | A | 11/1997 | Patel et al. | |
| 5,725,055 | A * | 3/1998 | Schirmer et al. | 166/264 |
| 6,050,131 | A * | 4/2000 | Willauer | 73/37 |
| 6,315,050 | B2 | 11/2001 | Vaynshteyn et al. | |
| 6,513,600 | B2 | 2/2003 | Ross | |
| 6,564,876 | B2 | 5/2003 | Vaynshteyn et al. | |
| 6,729,399 | B2 * | 5/2004 | Follini et al. | 166/264 |
| 6,865,933 | B1 | 3/2005 | Einarson et al. | |
| 6,938,698 | B2 | 9/2005 | Coronado | |
| 7,699,124 | B2 * | 4/2010 | Corre et al. | 175/60 |
| 2002/0014339 | A1 | 2/2002 | Ross | |
| 2002/0017386 | A1 | 2/2002 | Ringgenberg et al. | |
| 2002/0046835 | A1 | 4/2002 | Lee et al. | |
| 2004/0099443 | A1 | 5/2004 | Meister et al. | |
| 2004/0173363 | A1 | 9/2004 | Navarro-Sorroche | |
| 2006/0042793 | A1 * | 3/2006 | Del Campo et al. | 166/264 |
| 2007/0215348 | A1 * | 9/2007 | Corre et al. | 166/264 |
| 2008/0115575 | A1 * | 5/2008 | Meek et al. | 73/152.24 |
| 2008/0125335 | A1 | 5/2008 | Bhavsar | |
| 2008/0156487 | A1 | 7/2008 | Zazovsky et al. | |
| 2009/0008079 | A1 * | 1/2009 | Zazovsky et al. | 166/60 |
| 2009/0159278 | A1 * | 6/2009 | Corre et al. | 166/264 |
| 2009/0211756 | A1 * | 8/2009 | Goodwin et al. | 166/264 |
| 2009/0301635 | A1 * | 12/2009 | Corre et al. | 156/84 |
| 2009/0308604 | A1 * | 12/2009 | Corre et al. | 166/250.17 |
| 2010/0071898 | A1 * | 3/2010 | Corre et al. | 166/264 |

FOREIGN PATENT DOCUMENTS

| | | |
|---|---|---|
| EP | 0528328 | 2/1993 |
| EP | 0702747 | 3/1996 |
| WO | 03/018956 | 3/2003 |

* cited by examiner

SINGLE PACKER STRUCTURE WITH SENSORS

CROSS-REFERENCE TO RELATED APPLICATION

This application claims priority under 35 U.S.C. §119(e) to U.S. Provisional Application Ser. No. 61/116,442, filed on Nov. 20, 2008, which is incorporated herein by reference.

BACKGROUND

Packers are used in wellbores to isolate specific wellbore regions. A packer is delivered downhole on a conveyance and expanded against the surrounding wellbore wall to isolate a region of the wellbore. Two or more packers can be used to isolate one or more regions in a variety of well related applications, including production applications, service applications and testing applications.

In some applications, straddle packers are used to isolate specific regions of the wellbore to allow collection of fluid samples. However, straddle packers employ a dual packer configuration in which fluids are collected between two separate packers. Existing designs often do not provide an operator with sufficient information regarding downhole parameters. Additionally, the straddle packer configuration is susceptible to mechanical stresses which limit the expansion ratio and the drawdown pressure differential that can be employed. Other multiple packer techniques can be expensive and present additional difficulties in collecting samples and managing fluid flow in the wellbore environment.

SUMMARY

In general, the present invention provides a system and method for collecting formation fluids through a single packer having at least one drain located within the single packer. The single packer is designed with an outer flexible skin and one or more drains coupled to the outer flexible skin. The single packer further comprises one or more sensors positioned to detect one or more specific parameters.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
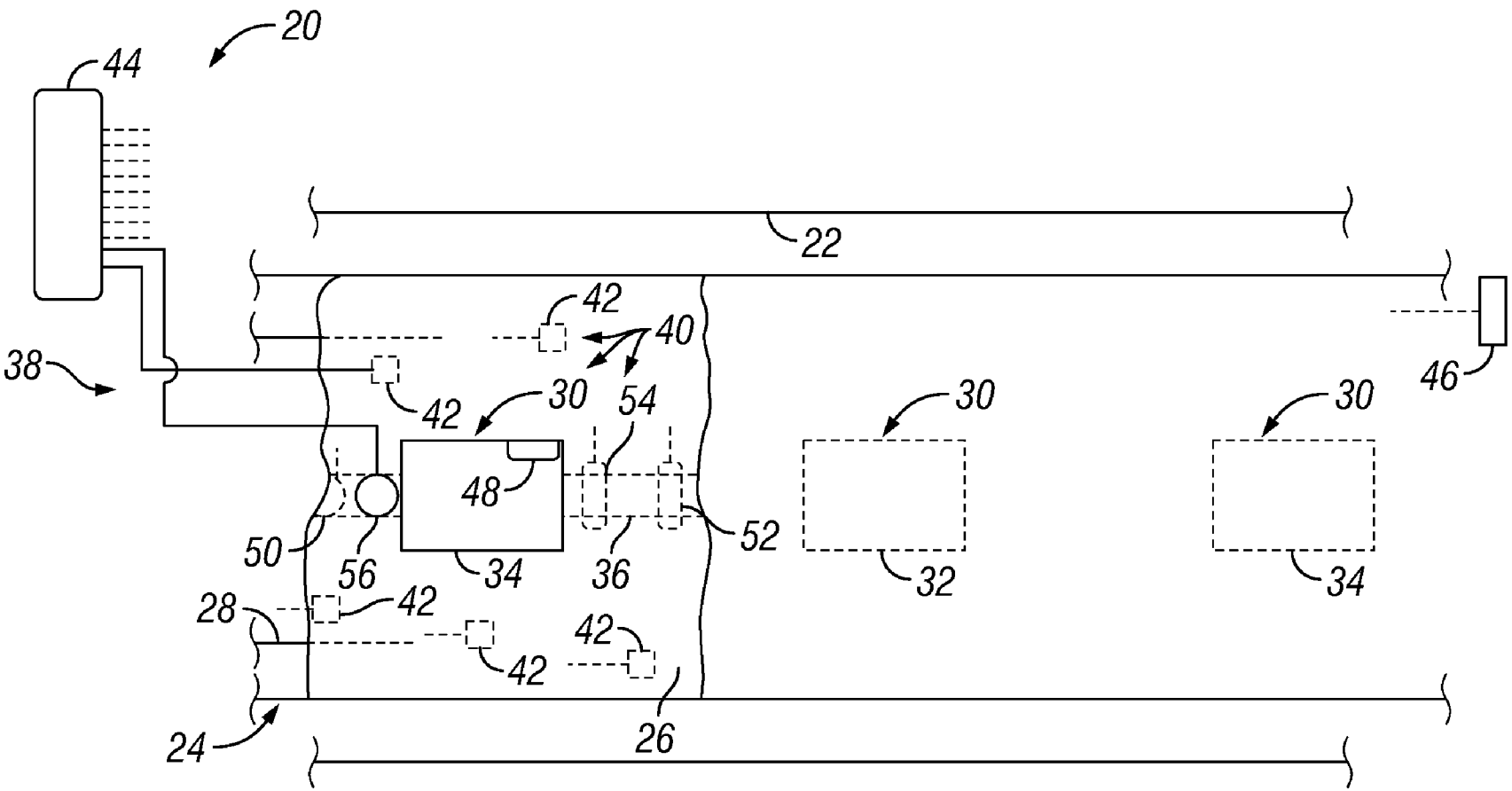
FIG. 1 is a schematic view of a portion of a single packer positioned in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for collecting formation fluids through one or more drains located in a packer, such as a single packer. Use of the single packer enables larger expansion ratios and higher drawdown pressure differentials. Additionally, the single packer configuration reduces the stresses otherwise incurred by the packer tool mandrel due to the differential pressures. In at least some embodiments, the single packer also is better able to support the formation in a produced zone at which formation fluids are collected. This quality facilitates relatively large amplitude draw-downs even in weak, unconsolidated formations.

The single packer expands across an expansion zone, and formation fluids can be collected from the middle of the expansion zone, i.e. between axial ends of the single packer. The formation fluid is collected and directed along flow lines, e.g. along flow tubes, from the one or more drains. For example, separate drains can be disposed along the length of the packer to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

The single packer provides a simplified packer structure that facilitates, for example, focused sampling. In one embodiment, one or more sensors are positioned along the single packer to monitor desired parameters. By way of example, the parameters may be related to well characteristics, including characteristics of flowing fluid, and/or to actuation of the single packer. In some applications, sensors can be incorporated into an outer flexible layer, e.g. an outer rubber layer. The outer flexible layer also may be used to contain drains, such as groups of drains in which a middle group comprises sampling drains and two axially outer groups comprise guard drains. The drains may be coupled to the flowlines in a manner that facilitates expansion and contraction of the single packer.

According to one embodiment, the present system and methodology generally relate to an instrumented packer assembly and methods for setting instrumentation into the packer assembly. The instrumentation may comprise one or more sensors designed to detect, measure and/or monitor downhole parameters. As described below, the sensors can be used with a single packer assembly to facilitate monitoring and operation of the packer assembly. The packer assembly, for example, enables placement of sensors to measure the packer expansion ratio and/or other measurements related to actuation of the packer. This allows for better control over operation of the packer. In some applications, measurements obtained downhole via packer sensors also can provide an indication of the level of stress applied to the packer. The sensors can further be used to measure well related parameters, such as fluid properties of fluids entering the packer during sampling procedures.

Referring generally to FIG. 1, one embodiment of a packer assembly 20 is illustrated as deployed in a wellbore 22. In this embodiment, the packer assembly 20 comprises an inflatable single packer 24 having an outer flexible skin 26 formed of expandable material, e.g. a rubber material, which allows for inflation of the packer 24. The outer flexible skin 26 is mounted around a packer mandrel 28, and comprises openings for receiving drains 30. By way of example, drains 30 may comprise one or more sampling drains 32 positioned between guard drains 34. The drains 30 are connected to corresponding flow lines 36 for transferring fluid received through the corresponding drains 30. The flow lines 36 connected to guard drains 34 may be separated from the flow lines connected to sample drains 32.

In the example illustrated in FIG. 1, single packer 24 further comprises a sensor system 38 having a plurality of sensors 40. By way of example, sensors 40 may comprise embedded sensors 42 that are embedded in outer flexible skin 26. In some applications, embedded sensors 42 are pressure sensors able to measure contact pressure exerted by outer flexible skin 26 against the surrounding wall, e.g. the wellbore wall. The pressure sensors may be formed as an array of mechanical or solid-state contact pressure sensors that provide local contact pressure information. Data on the local contact pressure may be particularly useful in applications where the formation has many smaller washouts that can cause compromised sealing with respect to one or more of the drains 30.

Data from the various sensors 40 is directed to a data acquisition system 44 which may be in the form of a computer based control system. With respect to the array off pressure sensors 42, the data acquisition system 44 may be employed to sample and store output from each sensor 42 during inflation of packer 24. The sensors may be numbered so the position of each sensor is known to the data acquisition system 44. As the output of each sensor 42 is sampled, the output is converted to contact pressure by data acquisition system 44. The local contact pressure is then compared to a global contact pressure predicted from the inflation pressure used to inflate packer 24. If one or more local pressure sensors 42 registers contact pressure that is significantly lower than the determined global contact pressure, an operator is better able to decide whether to move the entire packer 24 to a better position or to shut off one or more specific drains 30.

In an alternative approach, an average contact pressure based on data from local pressure sensors 42 can be determined. The average contact pressure is compared to the output of each sensor 42 to provide an indication of sealing integrity. The local contact pressures also can be used to prevent damage to the surrounding formation due to excessive pressure between the packer and the formation.

The plurality of sensors 40 also may comprise a variety of other types of sensors. For example, sensors 40 may comprise one or more extensometers 46 designed to detect and measure expansion of packer 24. Depending on the specific design of packer 24, the configuration of extensometers 46 can be selected to measure the expansion ratio of packer 24 via various techniques. By tracking expansion of packer 24, an operator is able to determine both the expansion ratio and whether the packer is or has been efficiently inflated. The sensors 46 also can be used to determine ovality and to control other operational parameters, such as ensuring full inflation while minimizing or optimizing inflation pressure. When sufficient pressure is applied to fully inflate packer 24, the extent of packer expansion can be measured by sensors 46 to determine whether full inflation has actually occurred. The extensometers 46 also may be used to provide measurements related to the deformation of outer flexible skin 26. Such information can be valuable in determining the integrity of or damage to inflatable packer 24. The information also can be valuable in determining the diameter of the outer flexible skin and thus the diameter of the borehole which is useful in providing job quality control, e.g. proper inflation, optimal tool selection, and washout detection. Data from extensometers 46 is delivered to data acquisition system 44 for appropriate processing.

In addition to the packer actuation sensors, e.g. sensors 42, 46, sensors 40 also may comprise sensors for measuring well related properties/characteristics. For example, sensors 40 may comprise one or more fluid property sensors 48, such as temperature sensors. When fluid property sensors 48 comprise temperature sensors, the temperature sensors can be used within packer 24 for quality control. For example, temperature sensors 48 are useful in very low or very high temperature wells in which the properties of the outer flexible skin 26 are affected and can inhibit optimal operation of packer 24. For example, temperature can affect the ability of outer flexible skin 26 to form adequate seals, and temperature also can render the outer flexible skin more sensitive to extrusion and deformation and thus a decreased lifetime. If the information is obtained and relayed from sensors 48 to data acquisition system 44, the information can be used to predict the number of stations at which inflatable packer 24 is likely to perform in the given conditions.

The fluid property sensors 48 may be located within one or more of the sampling drains 32 and guard drains 34. In some applications, for example, fluid property sensors 48 comprise formation pressure sensors installed within each sample drain 32 and guard drain 34. By way of example, the formation pressure sensors may be mounted on an opposite side of the flow line 36 for each sample drain and may be mounted perpendicular to the flow line 36 for each guard drain.

When fluid property sensors 48 comprise pressure sensors within each drain 30, the sensors 48 may be used for a variety of purposes. For example, the sensors 48 may be used to detect leaks and/or plugging prior to formation testing measurements. When formation pressure sensors are used to monitor for leaks, the output from each sensor 48 can be compared to the wellbore pressure. In the event pressure is registered by sensors 48 as on par with the wellbore pressure during a drawdown, an operator is able to determine that either the sealing has been compromised or a flow line 36 is plugged. Also, if the pressure sensors 48 have sufficiently high resolution, individual sensors can be used to take pretest measurements in the formation and can further be used in performing transient pressure build up measurements. However, application of these various techniques depends on the degree of isolation with respect to guard drains and sample drains.

Fluid property sensors 48 may be positioned within drains 30 or at other suitable locations, such as within flow lines 36 and/or in collectors at the axial ends of packer 24. The fluid property sensors are extremely useful in providing direct measurements of fluid properties close to the formation. For example, sensors 48 can be used to measure temperature, viscosity, velocity, pressure, or other fluid parameters at each drain 30. The data enables numerous evaluations, including verification of sealing by detecting clean/dirty fluid. The data also can provide an indication as to whether flow lines are plugged, leaking, or incurring other types of problems.

In many applications, sensors 40 also may comprise one or more pressure gauges 50 deployed in flow lines 36. Additionally, sensors 40 may comprise one or more sensor cells 52 positioned at suitable locations, e.g. within flow lines 36, to measure density, resistivity, viscosity, and other parameters of the fluid flowing into packer 24. Resistivity measurements can be used for obtaining data related to clean-up time and sample assurance during a sampling operation. Additionally, sensors 40 may comprise one or more flow meters 54 that can be used to measure flow rates within flow lines 36 or at other locations within packer 24.

The sensors 40 may be positioned at a variety of locations depending on the parameters measured and depending on the durability of the sensor. For example, sensors can be located within collectors at the end of the packer instead of in drains 30 to improve reliability. Additionally, sensors can be mounted in front of each flow line entrance for individual measurements or inside flow line collectors to obtain average measurements.

By positioning one or more sensors 40 on and/or in inflatable packer 24, the sensors are useful for detecting many operational parameters. For example, the sensors 40 can be used individually or in cooperation to detect packer inflation, an opening of a first flow line 36, a drawdown pressure initiated, an opening of a subsequent flow line, an occurrence of a leak, a shut down of flow lines upon leak detection, selected fluid properties, and a variety of other parameters and operational events.

Control over flow through individual flow lines 36 can be achieved by placing valves 56 in desired flow lines 36. The valves 56 are used to open or shut down individual flow lines upon the occurrence of specific events, such as leakage proximate a given drain 30. The control system/data acquisition system 44 also can be designed to exercise control over the opening and closing of valves 56.

Figure 2:
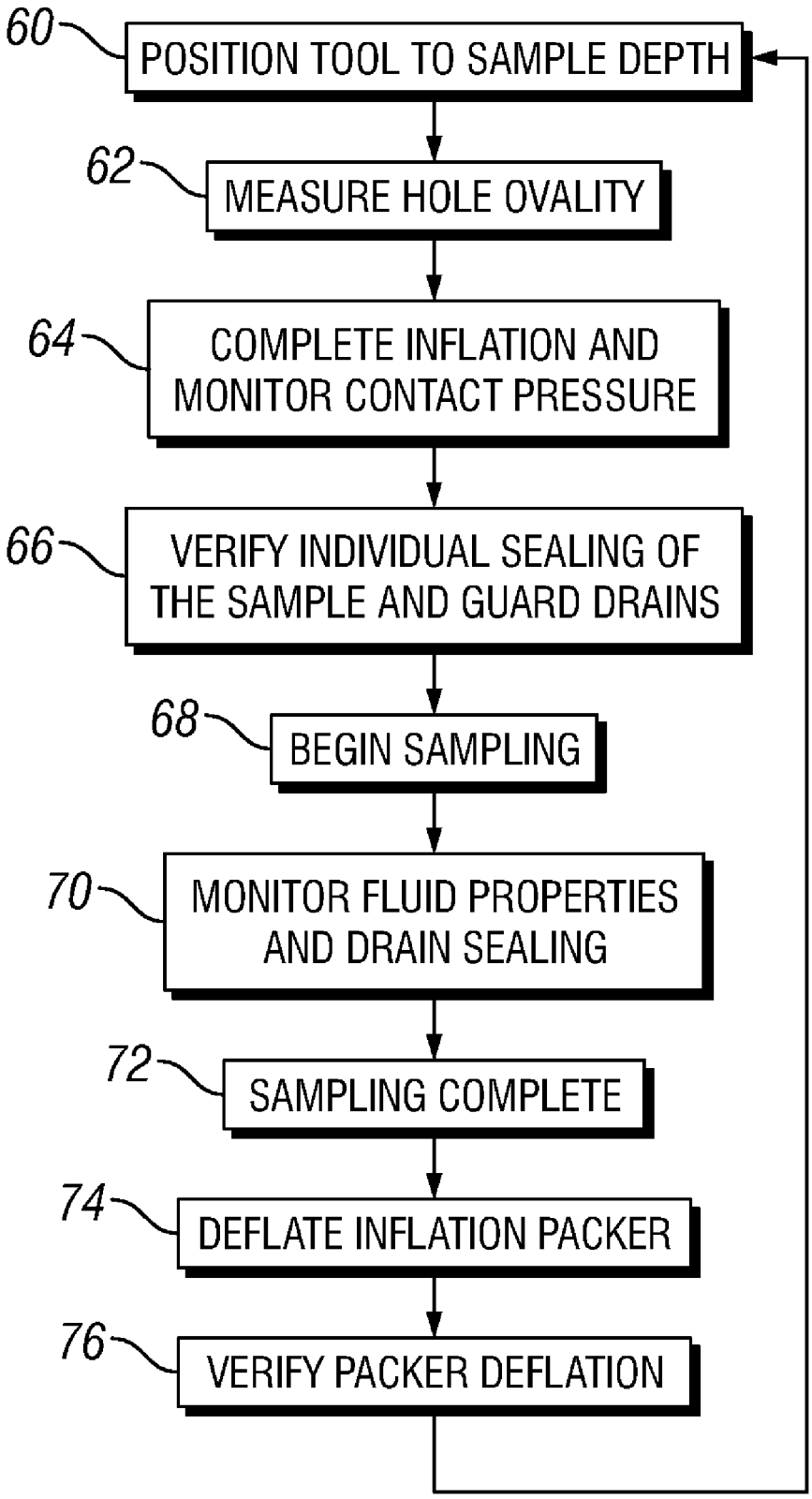
FIG. 2 is a flow chart illustrating one procedural example for using the single packer, according to an embodiment of the present invention.

Referring generally to FIG. 2, a flow chart is provided to illustrate one embodiment of a procedure utilizing packer assembly 20. In this example, inflatable packer 24 is initially moved to a desired sample depth in wellbore 22, as indicated by block 60. The sensors 40, e.g. extensometers 46, are then used to measure hole ovality, as illustrated by block 62. Subsequently, packer 24 is fully inflated and the contact pressure with the surrounding wellbore wall is monitored via embedded pressure sensors 42, as indicated by block 64. The sensors 40, e.g. fluid property sensors 48, also can be used to verify individual sealing of the sample drains 32 and the guard drains 34, as indicated by block 66.

Once the inflatable packer 24 is properly positioned in the wellbore and sufficient sealing is verified, the sampling procedure begins, as illustrated by block 68. During the sampling procedure, the fluid properties and drain sealing may be monitored by appropriate sensors 40, as illustrated by block 70. Subsequently, the sampling procedure is completed, as indicated by block 72, and the packer 24 is deflated, as indicated by block 74. The sensors 40, e.g. extensometers 46, can again provide data to data acquisition system 44 to verify packer deflation, as indicated by block 76. Upon deflation, the packer 24 may be moved to the next sampling location, and the procedure may be repeated.

Figure 3:
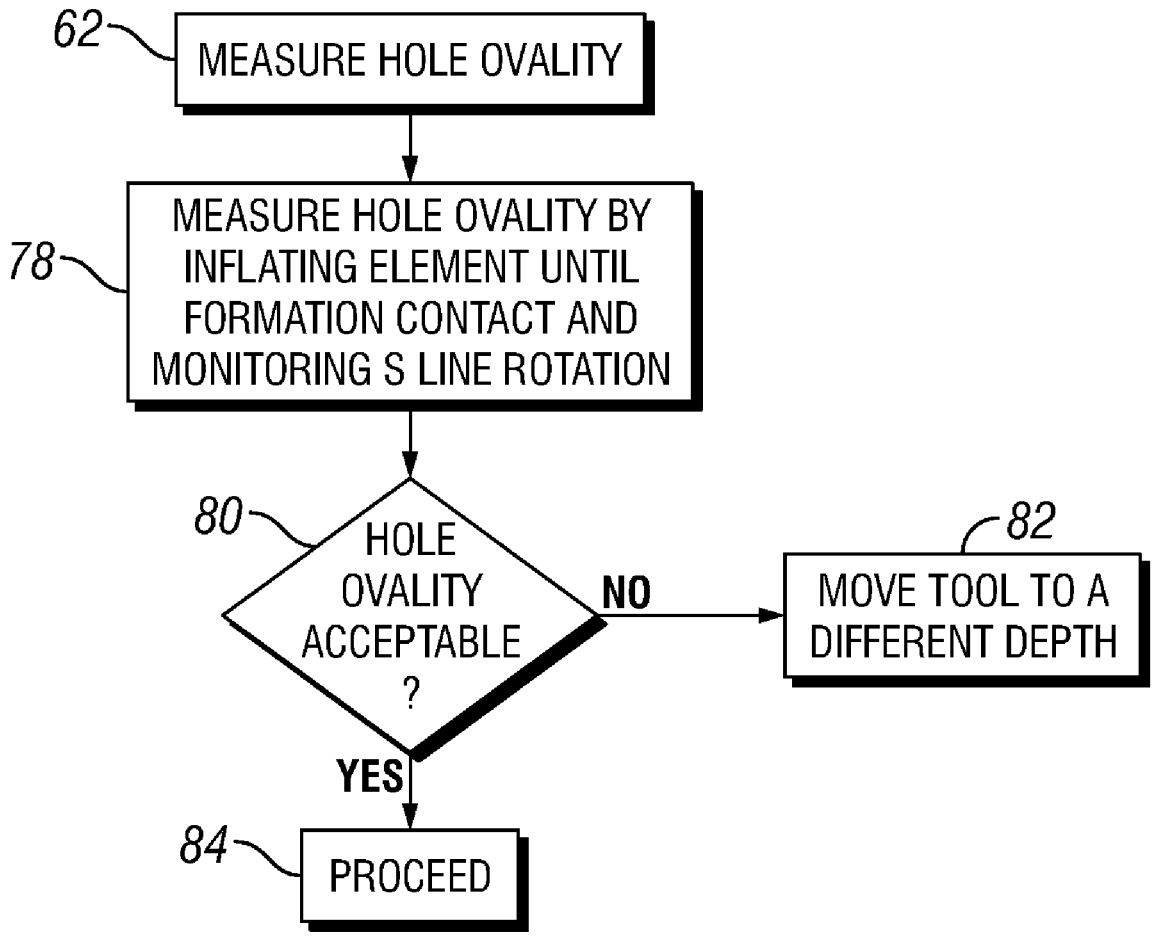
FIG. 3 is a flow chart illustrating a portion of the procedural example of FIG. 2, according to an embodiment of the present invention.

Depending on the specific application and environment, various procedural steps can be added, removed, and/or expanded. Furthermore, data acquisition system 44 can be programmed to utilize sensor data according to a variety of paradigms. As illustrated in FIG. 3, for example, measurement of hole ovality may be tested and used to determine placement of the inflatable packer 24. In this example, the measurement of hole ovality is accomplished by inflating packer 24 until contact pressure sensors 42 indicate contact with the surrounding wall, as indicated by block 78. Additionally, data obtained from extensometers 46 can be used as an indicator of the degree of expansion at packer ends and/or other locations along packer 24. As described in greater detail below, the extensometers 46 may be designed and positioned to measure rotation of S-shaped connector flow lines. The data from the various sensors 40 is processed by data acquisition system 44 to determine whether the hole ovality is acceptable, as indicated by block 80. If no, the packer 24 is moved to a different location and depth, as indicated by block 82. If yes, the process can proceed to the next stage and the sampling procedure can be continued, as indicated by block 84.

Figure 4:
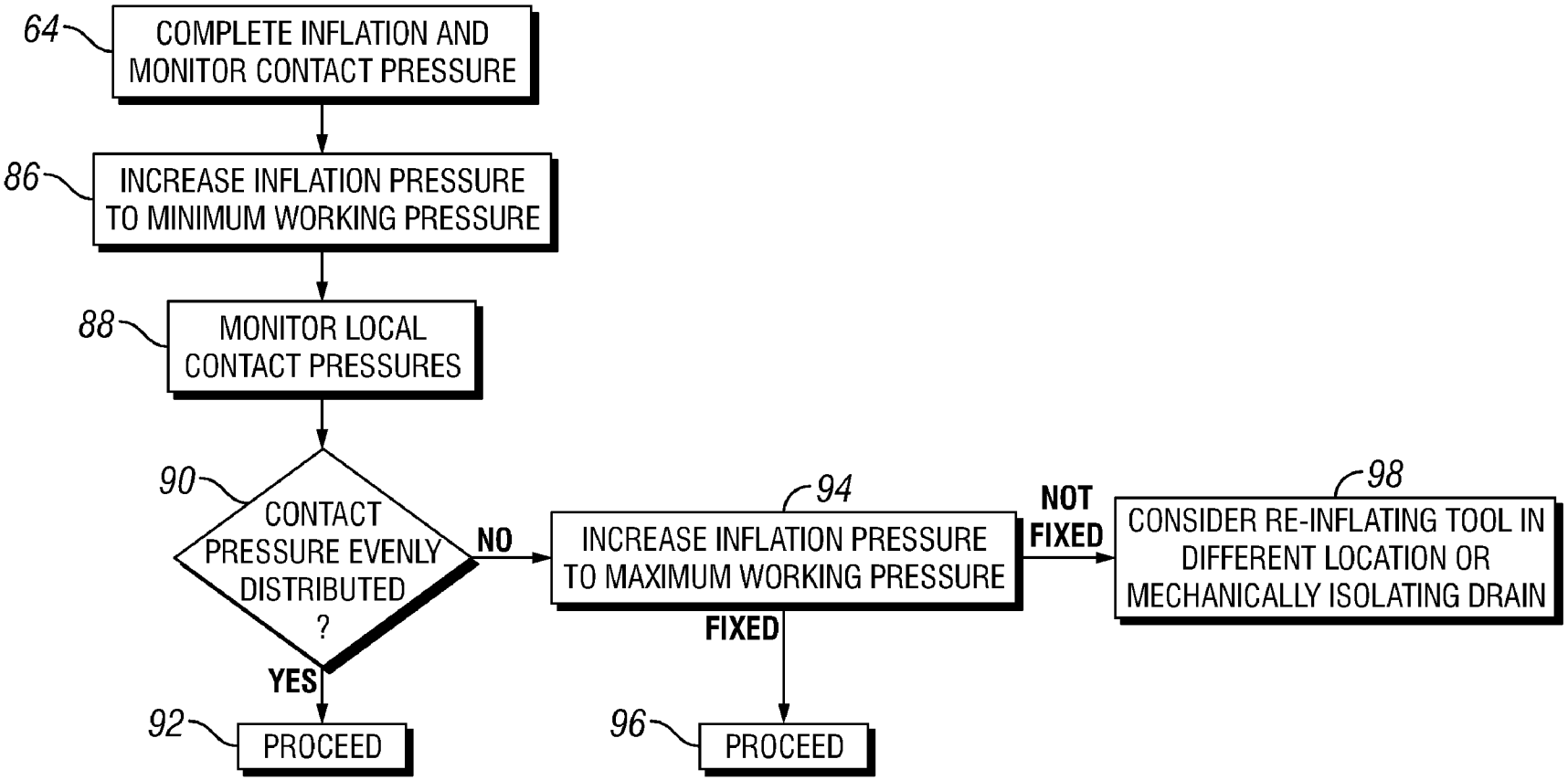
FIG. 4 is a flow chart illustrating another portion of the procedural example of FIG. 2, according to an embodiment of the present invention.

Similarly, the procedural stage involving completion of inflation and monitoring of contact pressure also may utilize output from various sensors 40, as illustrated by the flowchart of FIG. 4. In this example inflation pressure is initially increased to a minimum working pressure, as indicated by block 86. Contact pressure sensors 42 are used to monitor local contact pressures, as indicated by block 88, and the contact pressure data is provided to data acquisition unit 44. The data acquisition unit is used to determine whether contact pressure is evenly distributed, as indicated by block 90. If the pressure is sufficiently evenly distributed, the process can proceed to the next stage and the overall sampling procedure can be continued, as indicated by block 92. However, if the contact pressure is not evenly distributed, then the inflation pressure of packer 24 is increased to a maximum working pressure, as indicated by block 94. If this action results in sufficiently evenly distributed contact pressure, the process can proceed to the next stage, as indicated by block 96. If, however, the data does not indicate an evenly distributed contact pressure, additional corrective action can be taken, as indicated by block 98. For example, the packer 24 can be reinflated at a different location or one or more of the drains 30 can be mechanically isolated.

Figure 5:
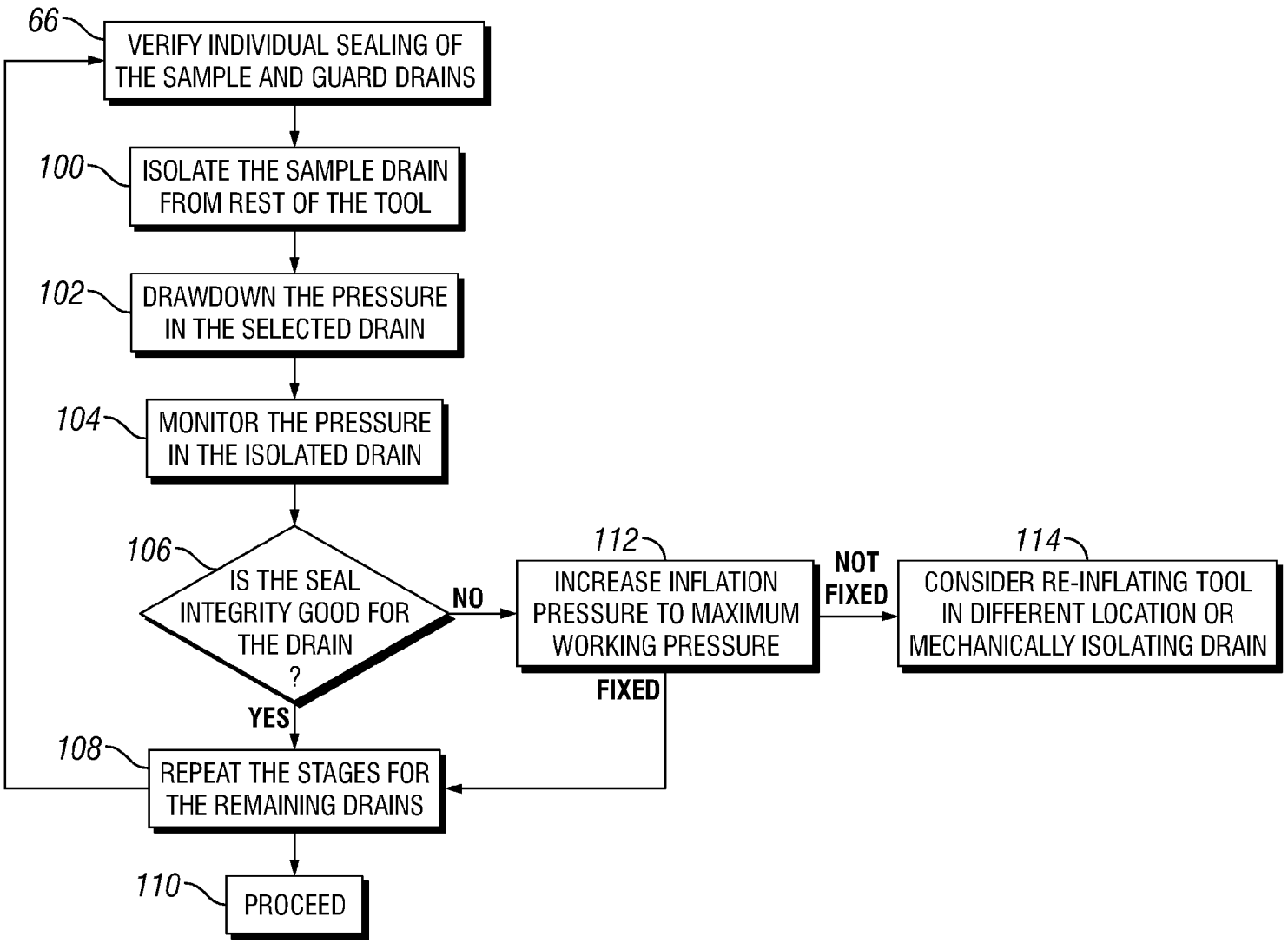
FIG. 5 is a flow chart illustrating another portion of the procedural example of FIG. 2, according to an embodiment of the present invention.

The verification of sealing with respect to individual sample drains and guard drains also may comprise additional procedural steps and utilization of sensor data, as illustrated by the flowchart of FIG. 5. In this example, the isolation of an individual drain, e.g. a sample drain 32, is initially tested, as indicated by block 100. A drawdown of pressure is applied to the selected drain, as indicated by block 102. The pressure in the isolated drain is monitored via an appropriate sensor, e.g. the fluid property sensor 48 in the subject drain, as illustrated by block 104. The sensor data is supplied to data acquisition system 44 which processes the data to determine whether the seal integrity is sufficient for the subject drain, as indicated by block 106.

If the seal integrity is sufficient, the sealing verification stages are repeated for each of the remaining drains, as indicated by block 108, until the verification process is completed and the overall sampling process can be moved to the next stage, as indicated by block 110. If the seal integrity of a given drain is not sufficient, the inflation pressure of packer 24 can be increased to a maximum working pressure, as indicated by block 112. Assuming the increased pressure results in sufficient seal integrity, the stages can be repeated for the other drains. However, if the action does not result in sufficient seal integrity additional corrective action can be taken, as indicated by block 114. For example, the packer 24 can be reinflated at a different location or one or more of the drains 30 can be mechanically isolated.

Figure 6:
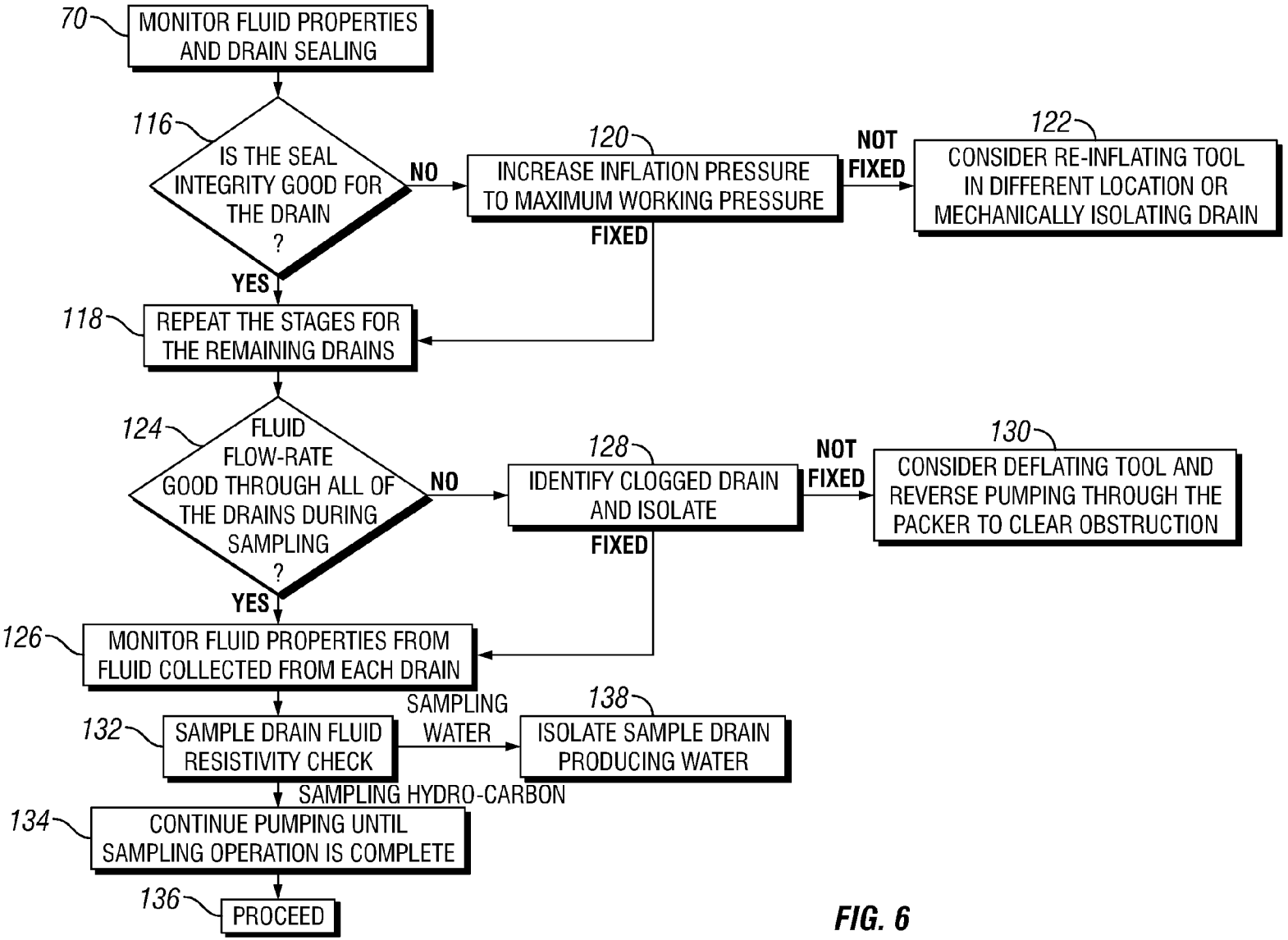
FIG. 6 is a flow chart illustrating another portion of the procedural example of FIG. 2, according to an embodiment of the present invention.

The monitoring of fluid properties and drain sealing following initiation of the sampling procedure also may comprise additional procedural steps and utilization of sensor data, as illustrated by the flowchart of FIG. 6. In this example, data from fluid property sensors 48 positioned in individual drains 30 or at other suitable locations provides data indicative as to whether the seal integrity is sufficient for an individual drain, as represented by block 116. If the seal integrity is sufficient for the individual drain, the process can be repeated for the remaining drains as indicated by block 118. However, if the seal integrity of a given drain is not sufficient, the inflation pressure of packer 24 can be increased to a maximum working pressure, as indicated by block 120. Assuming the increased pressure results in sufficient seal integrity, the procedural stages can be repeated for the other drains. However, if the action does not result in sufficient seal integrity additional corrective action may be taken, as indicated by block 122. For example, the packer 24 can be reinflated at a different location or one or more of the drains 30 can be mechanically isolated.

Once the seal integrity for each of the drains is addressed, the fluid flow rate through each drain is detected by an appropriate sensor 40, e.g. flow meter 54, as indicated by block 124. If the flow rate is sufficient for the drains, the fluid properties from the fluid collected through each drain are monitored, as indicated by block 126. However, if the flow rate data indicates a clogged drain, the drain can be isolated by closing the associated valve 56, as indicated by block 128. In the event a clogged drain is corrected, the monitoring of fluid properties for the drain can be commenced once again. However, if the drain is not unclogged additional corrective action may be taken, as indicated by block 130. For example, the packer 24 can be deflated and fluid can be reversed pumped through the packer to clear the drain obstruction.

After the flow rates for the drains are addressed, the fluid resistivity can be checked for each sample drain 32 via, for example, resistivity sensors 52, as indicated by block 132. If the resistivity is indicative of the desired fluid flow, the pumping of sample fluid is continued until the sampling operation is completed, as indicated by block 134. Subsequently, the overall sampling process may be moved to the next stage, as indicated by block 136. In the event the resistivity data indicates the presence of an unwanted fluid, such as water, corrective action may be taken, as indicated by block 138. For example, the sample drain producing water can be isolated by adjusting the appropriate valve.

Figure 7:
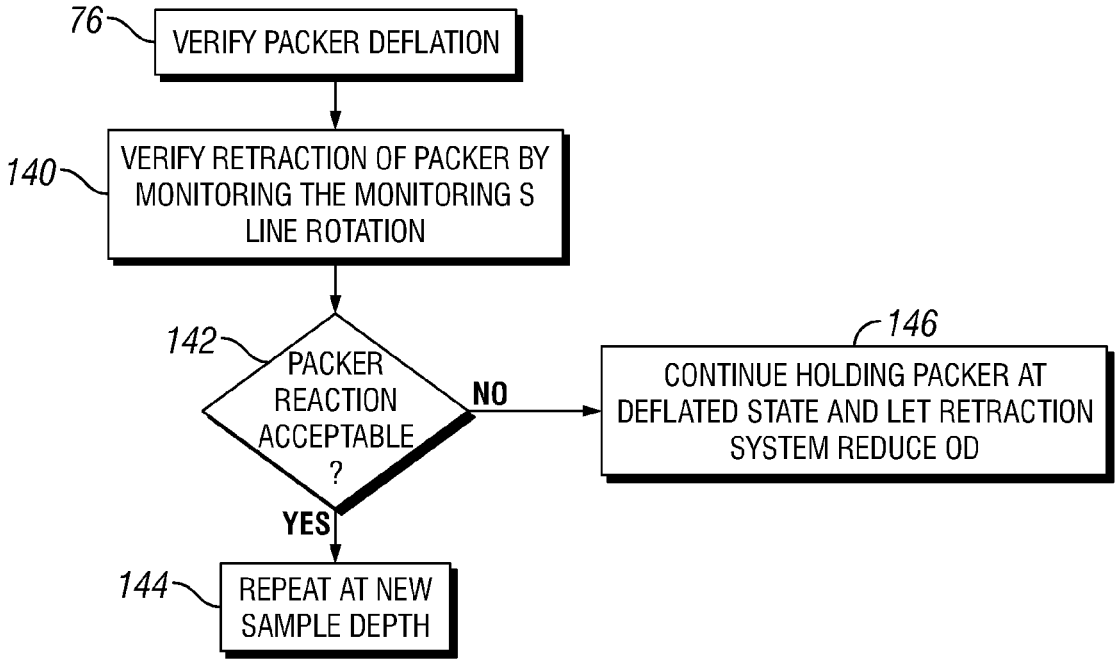
FIG. 7 is a flow chart illustrating another portion of the procedural example of FIG. 2, according to an embodiment of the present invention.

The verification of packer deflation upon completion of a sampling procedure also may comprise additional procedural steps and utilization of sensor data, as illustrated by the flowchart of FIG. 7. In this example, retraction of the packer 24 is verified by monitoring data output from suitable sensors 40, such as data output from extensometers 46, as indicated by block 140. For example, the extensometers 46 can be designed and positioned to measure rotation of S-shaped connector flow lines, which rotation is indicative of the degree of packer expansion. Data from the sensors 40 is provided to data acquisition system 44 to determine whether the packer retraction is acceptable, as indicated by block 142. If the packer retraction is acceptable, packer 24 may be moved to a new sample location at a different sample depth, as indicated by block 144. However, if the packer retraction is not acceptable, the packer is held at a deflated state, and a retraction tool or system can be used to reduce the outside diameter of the packer 24, as indicated by block 146.

The procedural examples illustrated and described above are just a few of the many procedural approaches that can be used in utilizing sensor system 38 and in obtaining fluid samples with single packer 24 in a variety of well environments. Similarly, the size, shape and configuration of packer 24 may vary depending on the specific sampling applications and environments.

Figure 8:
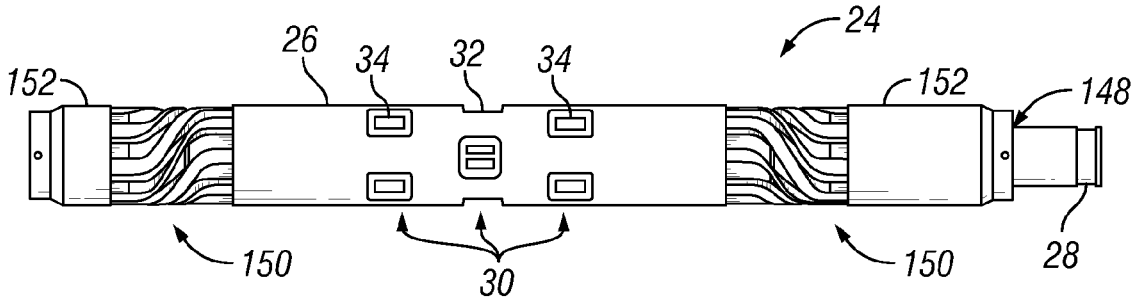
FIG. 8 is a front elevation view of one example of the single packer, according to an embodiment of the present invention.

One embodiment of a specific single packer design is illustrated in FIG. 8. In this example, packer 24 is a single packer having an outer layer formed as outer flexible skin 26 made of an elastic material, e.g. rubber. The outer flexible skin 26 is expandable in a wellbore to seal with a surrounding wellbore wall. The single packer 24 comprises an inner inflatable bladder 148 disposed within outer flexible skin 26. By way of example, the inner bladder 148 may be selectively expanded by introducing fluid via the interior packer mandrel 28. Additionally, the packer 24 comprises a pair of mechanical fittings 150 that may comprise fluid collectors 152 coupled with flow lines 36. The mechanical fittings 150 are mounted around inner mandrel 28 and engaged with axial ends of outer flexible skin 26.

Figure 9:
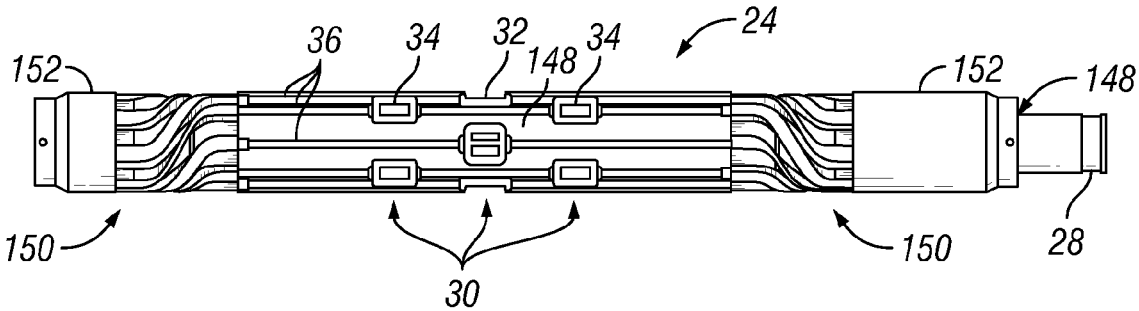
FIG. 9 is a broken away view of the packer illustrated in FIG. 8 to further illustrate internal components of the single packer, according to an embodiment of the present invention.

With additional reference to FIG. 9, the outer flexible skin 26 comprises openings for receiving drains 30 through which formation fluid is collected when the outer flexible skin is expanded against a surrounding wellbore wall. The drains 30 may be embedded radially into the outer flexible skin 26, and a plurality of the flow lines 36 may be operatively coupled with drains 30 for directing the collected formation fluid in an axial direction to one or both of the mechanical fittings 150. According to one embodiment, the flow lines 36 are in the form of tubes, and separate tubes are connected to the guard drains 34 and the sample drains 32 disposed between the guard drains. The separate tubes maintain separation between the fluids flowing into the guard drains and the sample drains, respectively.

As illustrated in FIG. 9, the flow line tubes 36 may be oriented generally axially along packer 24. The flow lines 36 extend through the axial ends of outer flexible skin 26. By way of example, flow line tubes 36 may be at least partially embedded in the flexible material of outer flexible skin 26. Consequently, the portions of flow lines 36 extending along outer flexible skin 26 move radially outward and radially inward during expansion and contraction of packer 24.

Figure 10:
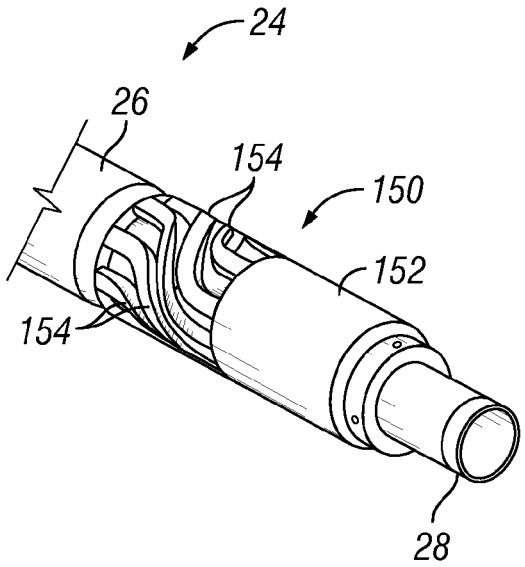
FIG. 10 is a view of one end of the packer illustrated in FIG. 8 when in a contracted configuration, according to an embodiment of the present invention.
Figure 11:
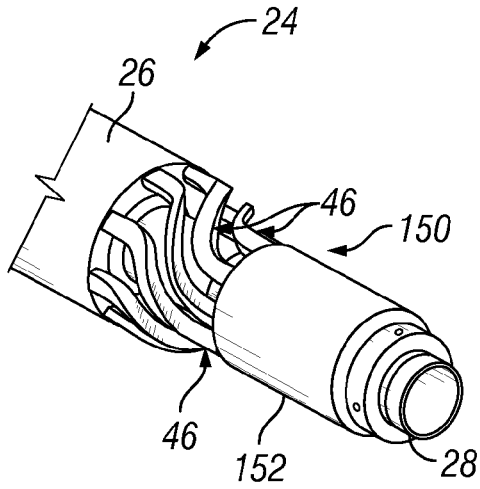
FIG. 11 is a view of one end of the packer illustrated in FIG. 8 when in an expanded configuration, according to an embodiment of the present invention.

Referring generally to FIG. 10, one embodiment of mechanical fittings 150 comprises the collector portion 152 coupled with a plurality of movable members 154. The movable members 154 are pivotably coupled to each collector portion 152 via pivot links for pivotable motion about an axis generally parallel with the packer axis. At least some of the movable members 154 are designed as tubes to transfer fluid received from the flow lines 36, extending along outer flexible skin 26, to collector portions 152. From collector portions 152, the collected fluids may be transferred/directed to desired collection/testing locations. The pivotable motion of movable members 154 enable transition of packer 24 between the contracted state, illustrated in FIG. 10, and the expanded state illustrated in FIG. 11. As illustrated best in FIG. 11, the movable members 154 may be designed generally as S-shaped members pivotably connected between flow lines in outer flexible skin 26 and collector portions 152.

In this particular embodiment of inflatable packer 24, extensometers 46 are designed as rotational sensors positioned to engage and measure rotation of select movable members 154. (See FIG. 11). By measuring the rotation angle of one or more movable members 154 and outputting the data to data acquisition system 44, the degree of expansion or contraction of packer 24 can be determined. Monitoring the rotation angle also enables determination of an average borehole diameter. This information is useful for quality control by facilitating detection of a damaged zone, proper inflation of packers, proper choice of downhole tools, and other operational factors.

The expansion ratio of the packer also is useful in providing a more accurate measurement of the borehole dimensions and its irregularities that can result from washouts and/or distorted ovality. The packer can effectively be used as a caliper tool which also is helpful in evaluating the wellbore. For example, by obtaining data on well ovalization, packer pressurization can be optimized to ensure sealing. In some types of packers, e.g. cable packers, the packer can experience weakening when inflated in oval wells. Consequently, data collected on wellbore ovalization is useful in ensuring that inflation pressure does not break an inner bladder of the packer. The measurement of packer outside diameter also is useful when the packer 24 is deflated. By knowing the degree of deflation, an operator can determine whether extraction of the packer is possible and whether retraction mechanisms, e.g. auto retract mechanisms, are operating efficiently.

Figure 12:
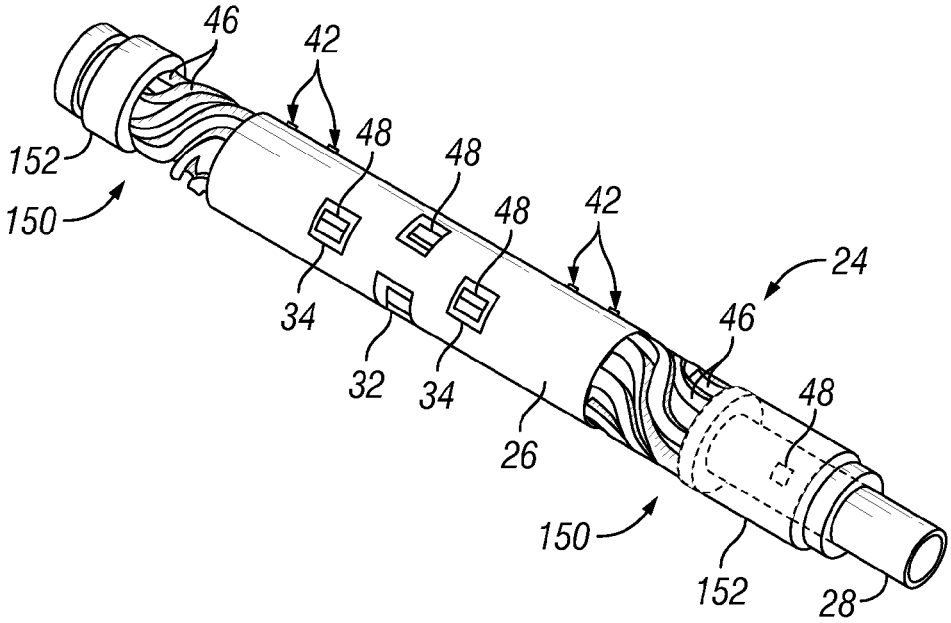
FIG. 12 is a view of the single packer illustrating examples of sensors that can be incorporated into the single packer, according to an embodiment of the present invention.

As illustrated in FIG. 12, this particular embodiment of inflatable packer 24 is amenable for use with a variety of the sensors 40 discussed above. As illustrated, sensors 42 can be embedded into outer flexible skin 26 to measure contact pressure or other parameters related to actuation of packer 24. Embedded sensors also could be used to detect parameters related to the well environment, e.g. fluid properties. Additional sensors 40, such as fluid property sensors 48, can be mounted in some or all of the drains 30. Alternatively or in addition, fluid property sensors 48 may be mounted in collector portions 152, as further illustrated in FIG. 12. The illustrated sensors may be interchanged with other sensors, and additional sensors can be added. For example, pressure gauges, flow meters, density meters, viscosity meters, resistivity meters, and other sensors can be mounted along packer 24, as discussed above.

Figure 13:
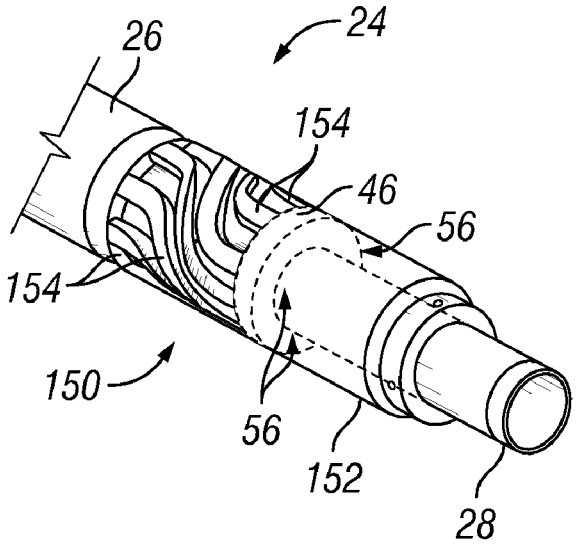
FIG. 13 is a view of the single packer illustrating examples of valves that can be incorporated into the single packer, according to an embodiment of the present invention.

Furthermore, valves 56 may be mounted in desired locations along flow lines 36, as illustrated in the example of FIG. 13. Individual valves 56 may be controlled by the data acquisition/control system 44 to control the flow of fluid along individual flow lines 36. The control over flow enables an operator to, for example, isolate specific drains 30 if a sufficient seal is not formed around the drain or if other problems arise with respect to a given drain or drains.

Figure 14:
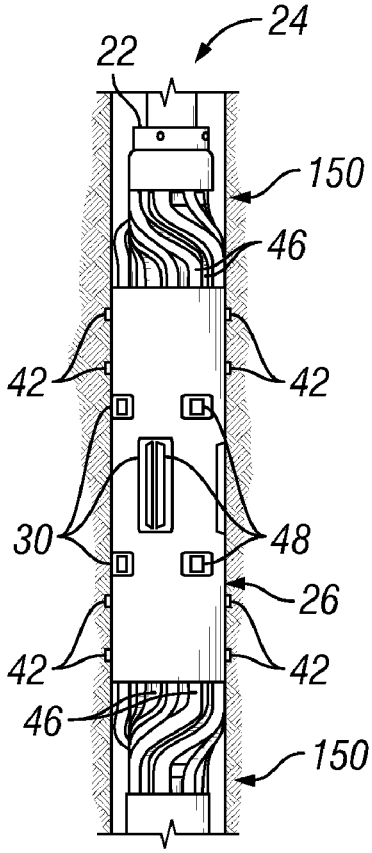
FIG. 14 is a view of the single packer expanded against a surrounding formation, according to an embodiment of the present invention.

The sensors 40 provide an instrumented packer 24 that may be selectively expanded, e.g. inflated, in a wellbore, as illustrated by FIG. 14. Once packer 24 is inflated, sensors 48 within drains 30 are placed in proximity with the surrounding formation 156 to facilitate detection and measurement of a variety of well related parameters, including fluid parameters. Other sensors can be used to detect additional well related parameters and/or to detect parameters related to actuation of the packer 24. For example, sensor data can be provided to data acquisition system 44 and used in determining whether the packer 24 has been adequately expanded or retracted and whether sufficient seals have been formed with the surrounding wellbore wall.

Also, in any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%. Components suitable for the rubbers described in this paragraph include, but are not limited to, outer flexible skin 26 and inflatable bladder 148.

As described above, packer assembly 20 may be constructed in a variety of configurations for use in many environments and applications. The packer 24 may be constructed from different types of materials and components for collection of formation fluids from single or multiple intervals within a single expansion zone. The flexibility of the outer flexible skin enables use of packer 24 in many well environments. Additionally, the various sensors and sensor arrangements may be used to detect and monitor many types of parameters that facilitate numerous procedures related to the overall sampling operation. Furthermore, the various packer components can be constructed from a variety of materials and in a variety of configurations as desired for specific applications and environments.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. An apparatus for use in a wellbore comprising:

an expandable packer assembly inflatable to seal against a wall of the wellbore, comprising:

an opening in the expandable packer assembly for receiving fluid into the expandable packer assembly from the wellbore or a formation about the wellbore;

a flowline connected to the opening for moving the fluid into the packer assembly, the flowline having at least a portion movable radially outward and radially inward during inflation and contraction of the packer assembly; and a sensor within the portion of the flowline for measuring movement of the flowline, wherein the portion of the flowline rotates as the packer assembly expands, and further wherein the sensor measures the rotation of the portion of the flowline to indicate an amount of the inflation of the packer assembly.

2. The apparatus of claim 1 wherein the sensor is an extensometer.

3. The apparatus of claim 1 further comprising an outer skin layer inflatable to expand the packer assembly, wherein the opening is formed in the outer skin layer.

4. The apparatus of claim 1 wherein the sensor is further capable of measuring a temperature of fluid received in the opening.

5. The apparatus of claim 1 further comprising a data acquisition unit in communication with the sensor to determine an expansion ratio of the packer assembly.

6. The apparatus of claim 1 where the portion of the flowline is s-shaped.

7. A method comprising:

deploying a packer assembly into a wellbore, the packer assembly inflatable toward a wall of the wellbore, the packer assembly having an opening connected to a flowline for receiving fluid and a first sensor on or within the flowline;

moving the flowline while inflating the packer assembly toward the wall of the wellbore; and measuring movement of the flowline with the first sensor; and determining a parameter related to inflation or contraction of the packer assembly based on the measurement of the movement of the flowline, wherein moving the flowline while inflating the packer assembly comprises rotating the flowline and further wherein the first sensor measures a rotation angle of the flowline.

8. The method of claim 7 further comprising controlling inflation of the packer assembly based on the measurement of the flowline.

9. The method of claim 7 wherein the step of determining a parameter related to inflation or contraction comprises determining an expansion ratio of the packer assembly.

10. The method of claim 7 wherein the first sensor determines a property of the fluid within the flowline.

11. The method of claim 7 further comprising determining contact pressure with the wall of the wellbore with a second sensor positioned adjacent the opening.

12. The method of claim 7 further comprising measuring a temperature of the fluid in the flowline or a temperature of an outer skin of the packer assembly with a second sensor or the first sensor.

13. The method of claim 7 further comprising measuring a property of the fluid with a second sensor or the first sensor in the flowline.

14. The method of claim 7 further comprising communicating with a data acquisition system to determine the parameter related to inflation or contraction of the packer assembly based on the measurement of the movement of the flowline.

15. The method of claim 7 further comprising determining contact pressure with wall of the wellbore with a second sensor positioned adjacent the opening, and comparing pressure at the second sensor to a predicted pressure.

16. The method of claim 15 wherein the opening is closed based on the comparison of the contact pressure and the predicted pressure.

17. The method of claim 7 further comprising utilizing the first sensor to optimize inflation pressure of the packer assembly.

* * * * *